US007797870B2

(12) United States Patent
Barnett

(10) Patent No.: US 7,797,870 B2
(45) Date of Patent: Sep. 21, 2010

(54) RIFLE BOLT LINKAGE MECHANISM

(76) Inventor: Robert L. Barnett, 1428 E. Borchard, Santa Ana, CA (US) 92705

( * ) Notice: Subject to any disclaimer, the term of this patent is extended or adjusted under 35 U.S.C. 154(b) by 0 days.

(21) Appl. No.: 12/395,986

(22) Filed: Mar. 2, 2009

(65) Prior Publication Data

US 2009/0241395 A1 Oct. 1, 2009

Related U.S. Application Data

(63) Continuation of application No. 11/608,105, filed on Dec. 7, 2006, now Pat. No. 7,497,042.

(51) Int. Cl.
*F41A 3/00* (2006.01)
*F41C 7/06* (2006.01)

(52) U.S. Cl. ..... 42/16; 42/20; 42/43; 42/69.01

(58) Field of Classification Search ..... 42/16–18, 42/20–22, 43, 45
See application file for complete search history.

(56) References Cited

U.S. PATENT DOCUMENTS

| | | | |
|---|---|---|---|
| 55,012 | A | 5/1866 | King |
| 57,808 | A | 9/1866 | Winchester |
| 2,112,268 | A | 3/1938 | Burton |
| 5,148,619 | A | 9/1992 | Badali |
| 5,758,444 | A | 6/1998 | Ruger et al. |
| 7,497,042 | B2 | 3/2009 | Barnett |
| 2005/0183312 | A1 | 8/2005 | Speaks |
| 2006/0080880 | A1 | 4/2006 | Taylor et al. |

OTHER PUBLICATIONS

Cowboys and Indians Website archived Dec. 17, 2005 at http://web.archive.org/web/20060708164052/www.cowboysandindianstore.com.
Letter dated Jul. 15, 2009 from Robert Barnett to Joe Alves.
Letter and enclosures dated Aug. 3, 2009 from Jeffrey Haendler to Robert Barnett.
Letter dated Aug. 25, 2009 from Jeffrey Haendler to Robert Barnett.
Letter dated Sep. 11, 2009 from Robert Barnett to Jeffrey Haendler and Joe Alves.
Letter dated Sep. 30, 2009 from Robert Barnett to Jeffrey Haendler and Joe Alves.
Letter dated Oct. 6, 2009 from Jeffrey Haendler to Robert Barnett.

*Primary Examiner*—Michael Carone
*Assistant Examiner*—Michael D David
(74) *Attorney, Agent, or Firm*—Knobbe, Martens, Olson & Bear, LLP

(57) ABSTRACT

A modified toggle link assembly for a lever action rifle including a modified slide channel that, in at least one embodiment, produces a shorter lever stroke and smoother lever cycle. The modified toggle link may also include a modified profile which defines a hump on an upper surface of the rearward link of the toggle link and a corresponding recess on the forward link. This hump allows for the modified geometry of the slide channel. The slide channel may be a modified straight path or a compound, or non-linear path.

12 Claims, 13 Drawing Sheets

RIFLE BOLT LINKAGE MECHANISM

PRIORITY INFORMATION

This application is a continuation of U.S. application Ser. No. 11/608,105, filed Dec. 7, 2006, the entirety of which is hereby incorporated by reference.

BACKGROUND OF THE INVENTION

1. Field of the Invention

The present invention is generally related to a rifle bolt linkage mechanism. More specifically, the present invention relates to an improved rifle bolt linkage mechanism for a lever action rifle which improves firing speed and lever action.

2. Description of the Related Art

Lever action rifles are very well known devices that have existed for over one hundred years and include a very rich history. Today many individuals engage in shooting competitions that are, in-part, a tribute to the rich heritage of these rifles. With the aid of modern technology, it has become a common pursuit to modify these rifles to perform better in a competitive environment.

One such modification that has been pursued in various forms is to shorten the distance that is needed to fully open the lever of a lever action rifle. This modification can yield a shorter time between successive shots due to the shorter distance that is needed to re-cock the rifle between shots. This is especially desirable in competitions where rapid firing is the object of competition.

One such modification known in the art that can be made to a lever action rifle is to modify the slide channels of the toggle links of the internal lever action mechanism. The modification is comprised of using the original manufacture's toggle link shape and altering the straight slide channel angle. It is common to increase the angle of the slide channel to an extent that the original shape of the toggle link will allow.

Another modification that has been attempted in the art is to alter the dimensions of the lever of a lever action rifle by shortening the lever arm that extends into the frame of a rifle. This modification is commonly accomplished by cutting and reattaching the portion of the lever that extends into the frame of the rifle. A portion of the arm is cut away and removed and then the shortened arm is then reattached. The reattachment is commonly done by welding.

SUMMARY OF THE INVENTION

It has been determined by the present inventor that one such disadvantage of the above mentioned modification of the slide channels is that a reduced wall thickness can occur which may result in failure of the toggle links. Furthermore, it has been determined by the present inventor that the modification of the lever arm and/or slide channel discussed above is often inaccurate and may result in a condition of the toggle link partially open (or not in "full battery") in the firing position of the rifle, which can be dangerous.

Accordingly a need exists for an improved toggle link mechanism that can yield a shorter lever stoke and a smoother lever cycle than existing modified toggle links. In addition, the preferred toggle links achieve full battery in the closed position of the lever.

A preferred embodiment is a modified action for a lever action rifle comprising a replacement toggle link movable by a lever of the rifle to reciprocate a breech block relative to a chamber end of a barrel of the rifle. The toggle link comprises a forward link and a rearward link. The forward link and the rearward link are pivotally coupled to one another. The toggle link further comprises a slide channel having a start end which extends rearwardly to a terminal end. The slide channel defines a non-linear path between the start end and the terminal end.

Another preferred embodiment is the modified toggle link for an original, or a replica of, a Winchester Model 1866-1873 rifle comprising a forward link and a rearward link. The forward link and the rearward link are pivotally coupled to one another. The modified link further comprises a slide channel defined by the rearward link that is substantially non-parallel to a bottom surface of the rearward link. The modified link further comprises a modified profile that is defined by the outer surfaces of the toggle link and is substantially different than a profile of an original equipment toggle link. The modified profile of the rearward link extends beyond the outer boundary of the original equipment rearward link to accommodate the slide channel. The modified profile of the forward link is configured to accommodate the modified profile of the rearward link.

Yet another preferred embodiment is a modified action for a lever action rifle comprising a replacement toggle link movable by a lever of the rifle to reciprocate a breech block relative to a chamber end of a barrel of the rifle. The toggle link comprises a forward link and a rearward link. The forward link and the rearward link pivotally coupled to one another. The link further comprises a modified slide channel defined by a rearward link. An upper surface of the rearward link defines a hump configured to accommodate a heightened terminal end of the slide channel. An upper surface of the forward link defines a recess which is configured to receive the hump when the toggle link is in a collapsed position.

BRIEF DESCRIPTION OF THE DRAWINGS

These and other features, aspects, and advantages of the present rifle bolt linkage mechanism are described below with reference to drawings of preferred embodiments, which are intended to illustrate, but not to limit, the present invention. The drawings contain the following Figures.

DETAILED DESCRIPTION OF THE PREFERRED EMBODIMENT

Figure 1:
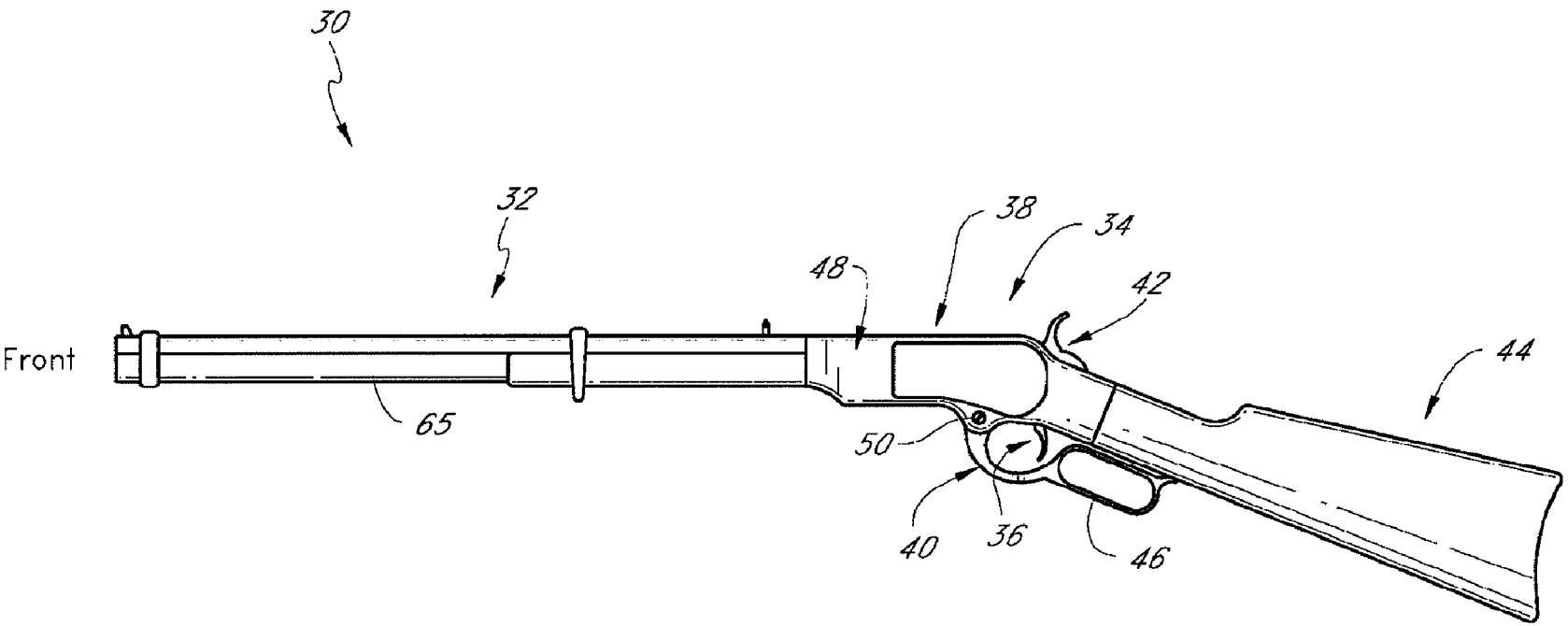
FIG. 1 is a side view of a lever action rifle.

FIG. 1 illustrates a rifle 30 that can utilize an embodiment of the modified rifle bolt linkage mechanism of the present invention. Throughout this description the terms front, rear, top, bottom, left, and right will refer to the corresponding positions of the rifle and components therein. These positions are in reference to the barrel of the rifle pointing to the front and the lever of the rifle pointing down, as it would normally be held by one shooting a rifle. These terms are intended only for convenience and are not intended to limit the scope of the invention.

A rifle that is preferably used with an embodiment of the present rifle bolt linkage mechanism is a Winchester® Model 1866 or a Model 1873 or any suitable replica. Although the embodiments described below are intended to be used with the aforementioned rifles it will become apparent to one skilled in the art that the technology may be utilized in any substantially similar lever action rifle.

The rifle 30, illustrated in FIG. 1, includes a barrel 32 that is configured to direct bullets towards a target when cartridges are discharged. The barrel 32 preferably includes spiral flights on the internal surface, or rifling, that are configured to impose spin on a bullet during its flight. Attached to the rear of the barrel 32 is the action 34 of the rifle 30 that includes a substantial portion of the mechanism that handles the operation of the rifle 30. These mechanisms include but are not limited to, a trigger mechanism 36, a cartridge receiver mechanism 38, a lever action mechanism 40, and the hammer mechanism 42. The internal workings of the action 34 will be discussed in greater detail below. Behind the action 34 is the stock 44 of the rifle 30 which is configured to support the rifle 30 against a shooters shoulder while the shooter aims and fires the rifle 30.

The action 34 of the lever action rifle 30 of FIG. 1 is unique from other rifle types because it uses a lever 46 that is mounted on the bottom portion of the action 34 and is configured to actuate the mechanism for discharging and reloading spent cartridges as well as arming, or cocking, the rifle 30. After the rifle 30 has been initially loaded, the shooter rotates the lever 46 down and forward which draws a cartridge into the chamber 48 of the rifle 30. This rotation of the lever 46 is commonly referred to as stroke. Once the cartridge has been fired, and the bullet has been discharged, the shooter then rotates the lever 46 down and forward, to its limit, and then rotates the lever 46 back to it original position up against the stock 44 thereby expelling the empty cartridge and reloading a new cartridge in to the chamber 48 of the rifle 30. During rotation, the lever 46 pivots about a lever pivot 50. The amount of rotation of the lever 46 that is needed to reload the rifle 30 is an important parameter that determines how quickly a rifle 30 can be repeatedly fired. That is, a shorter lever stroke corresponds to a faster firing time because the shooter will not have to move the lever 46 as far to cycle the action 34 between shots.

Figure 2:
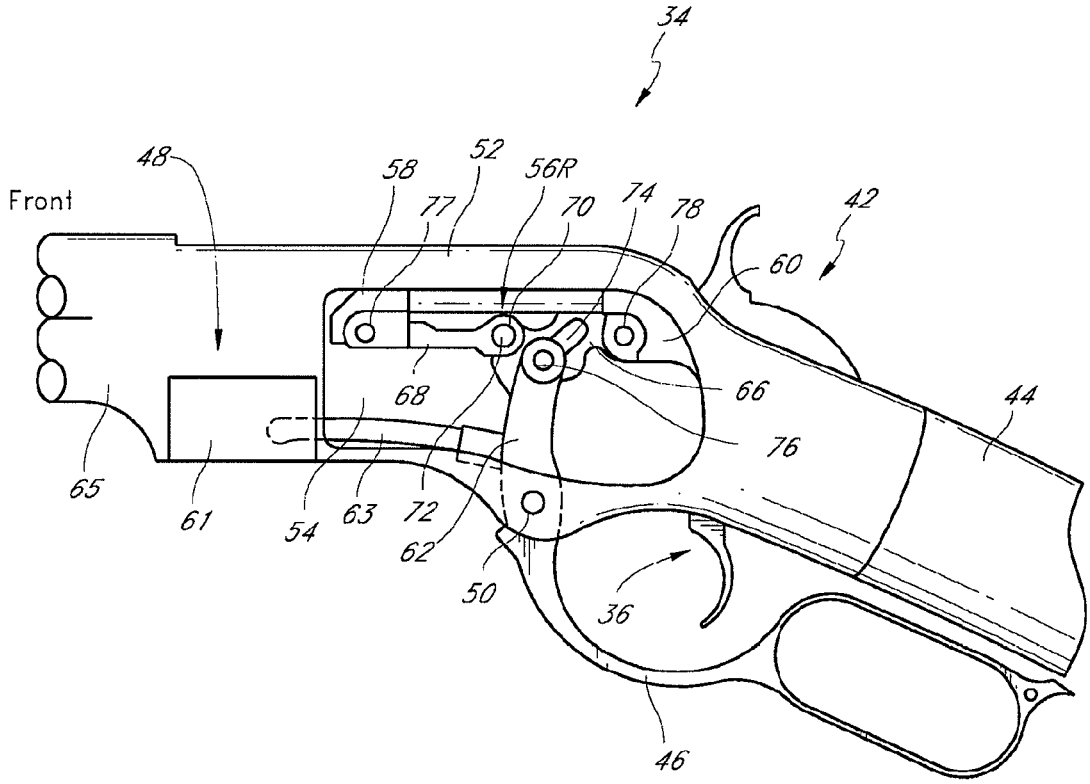
FIG. 2 is a side view of the action of the rifle of FIG. 1 with the lever in the closed position and with a side plate and components removed for clarity.
Figure 3:
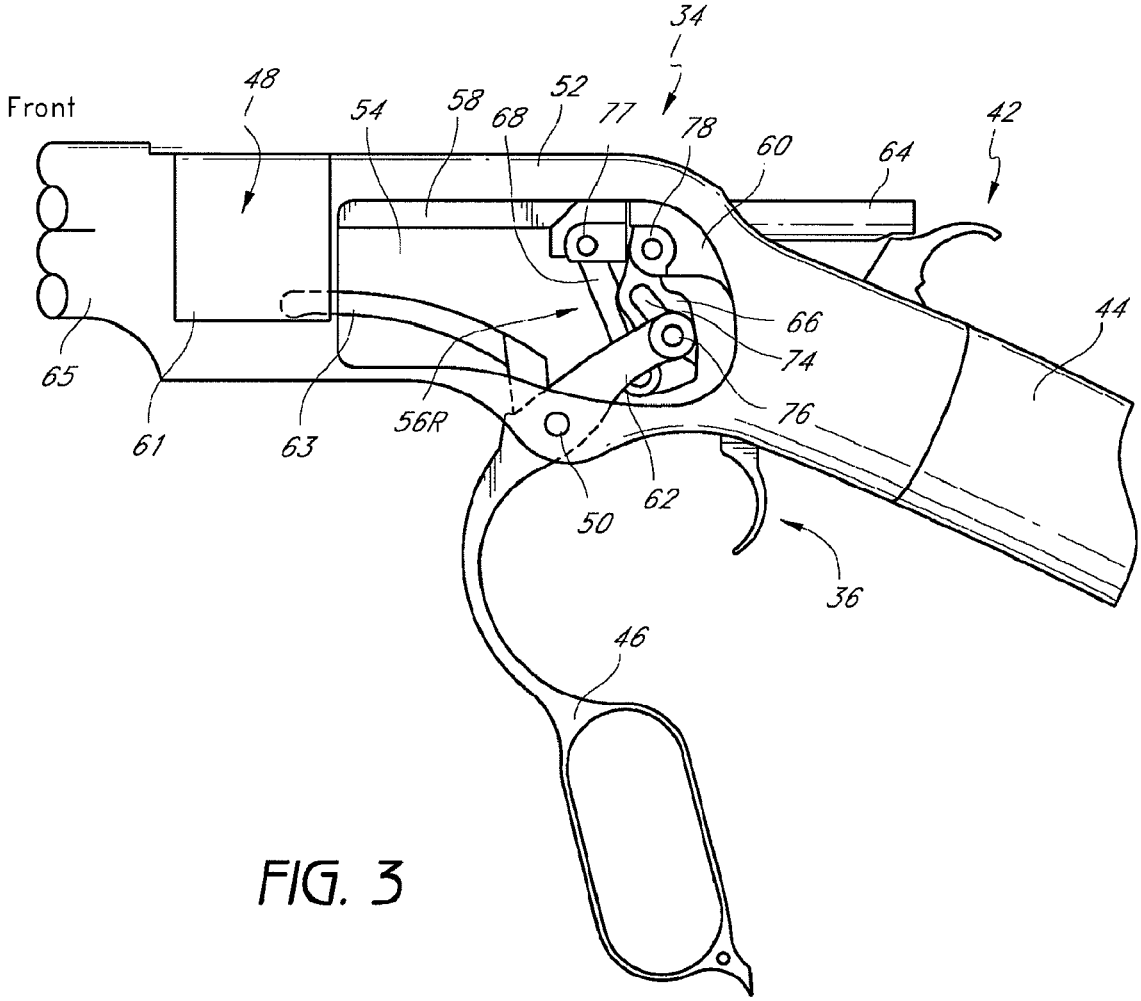
FIG. 3 is a side view of the action of the rifle of FIG. 1 with the lever in the open position and with a side plate and components removed for clarity.

With reference to FIGS. 2 and 3, an enlarged view of the internal components of the action 34 of the rifle 30 is shown. The action 34 includes a frame 52 which is configured to house and support the components of the action 34 and to serve as a main structural element of the rifle 30. The frame defines an action cavity 54 that is configured to house internal components of the action 34 and to allow access to the internal components for repair or service. The action 34 also includes a pair of toggle links that are configured to reciprocate a breech block 58 during cycling of the action 34 of the rifle 30. Preferably the toggle links 56 are substantially mirrored copies of one another. For clarity, only the right hand toggle link 56R is shown in FIGS. 2 and 3. The toggle link 56R is connected to a rearward toggle pivot support 60 that is integrally formed with the frame 52. The toggle link 56R is further connected to the rear of the breech block 58. The lever 46 is attached at the lever pivot 50 and is includes a lever arm portion 62 that extends into the action cavity 54 and interacts with the toggle link 56R.

As shown from FIG. 2 to FIG. 3, when the lever 46 is rotated down and forward, the lever arm 62 correspondingly rotates down and rearward. The lever arm 62 pulls the toggle link 56R down to a collapsed position, thus drawing the breech block 58 back and out of the chamber 48 of the rifle 30. The breech block 58 is also connected to a firing pin extension 64 which, when drawn back with the breech block, pushes the hammer mechanism 42 back and into a cocked position as shown in FIG. 3.

The raising of a carrier block 61 by a lifter arm 63 is also included with the actions that occur when the lever 46 is rotated down and forward. As well known in the art, the carrier block 61 is preferably a block of metal with two longitudinal holes which are drilled, front to back, through the block 61 with one above the other and are aligned with the barrel. The upper hole is configured to lift a new cartridge from the magazine tube 65 to the chamber 48. The lower hole is configured to receive the forward portion of the lifter arm 63 and to allow it to slide during lifting and dropping of the carrier block 61. The block 61 is configured to push out a used cartridge and lift up a new cartridge from the magazine tube 65. The lifter arm 63 is connected to the lever 46 at the lever pivot 50 and is configured to be lifted by the lever 46 at its rearward portion and to lift the carrier block 61 with its forward portion. The upper part of the carrier block 61 includes a longitudinal slot that allows the block 61 to drop back down after the chamber 48 has been closed by the breech block 58.

When the rifle 30 is fully assembled the action 34 includes a set of two toggle links 56 that are nearly mirrored copies of each other. The left and right hand toggle links, 56R and 56L, (shown in later Figures) include some slight differences in shape that will be discussed in greater detail below. The right and left toggle links 56 are configured to be positioned on opposite sides of the breech block 58 and lever arm 62. The two links 56 work in combination to support both sides of the breech block 58 and lever arm 62.

With reference to FIG. 2, the toggle link 56R includes two main components which include the rearward link 66 and the forward link 68. The rearward link 66 and the forward link 68 are connected at a central toggle pivot 70 by a central toggle pivot pin 72. The rearward toggle link 66 includes a slide channel 74 that is configured to receive a lever arm pin 76 that is located at the end of the lever arm 62. The channel 74 is configured to compensate for the changing distances between the lever arm pin 76 and the rearward toggle pivot 78 during cycling of the action 34. The forward link 68 of the toggle link 56R is configured to rigidly connect the breech block 58 to the central toggle pivot 70. When the breech block 58 is in the open position, as shown in FIG. 3 the toggle link 56R is collapsed with the forward link 68 folded up and against the rearward link 66. When the breech block 58 is in the closed position the forward link 68 and the rearward link 66 are in an extended position with the forward toggle pivot 77, the central toggle pivot 70 and the rearward toggle pivot 78 in a substantial linear configuration. This linear configuration preferably includes the central toggle pivot 70 to be slightly above the forward toggle pivot 77 and rearward toggle pivot 78 to ensure that the toggle link 56R is in a straight and locked position to hold the breech block 58 closed during cartridge discharge which is referred to as "full battery".

Figure 4:
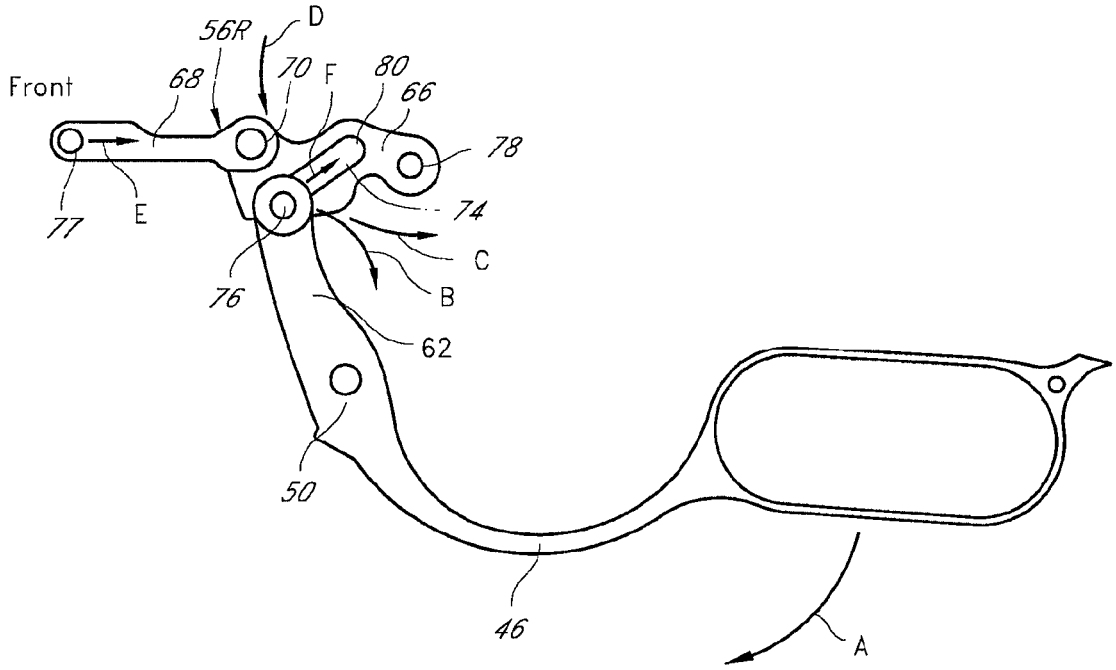
FIG. 4 is a side view of the toggle link and lever assembly removed from the rifle of FIG. 1 and shown in the closed position.
Figure 5:
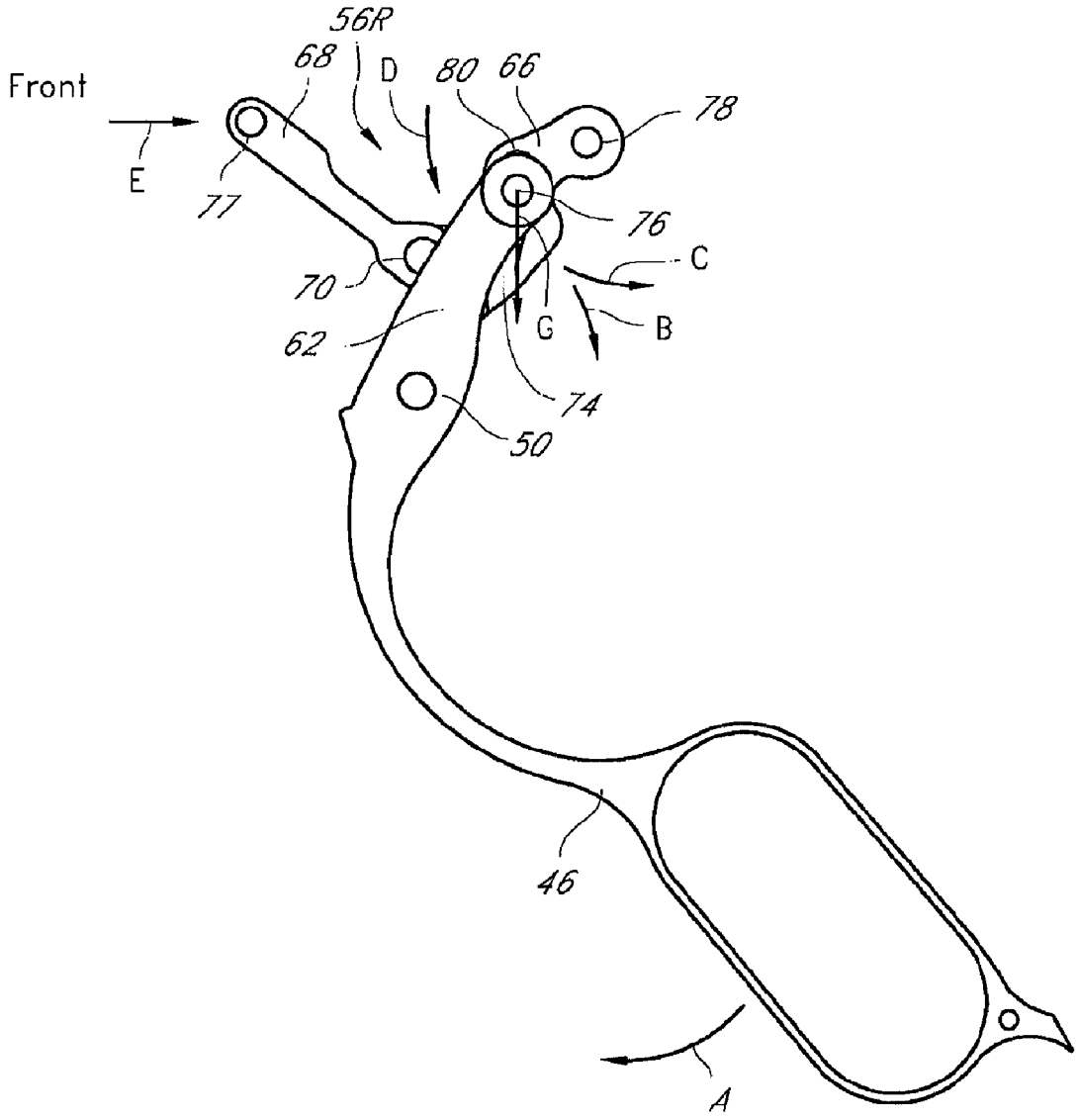
FIG. 5 is a side view of the toggle link and lever assembly removed from the rifle of FIG. 1 and shown partially through a lever opening cycle.
Figure 6:
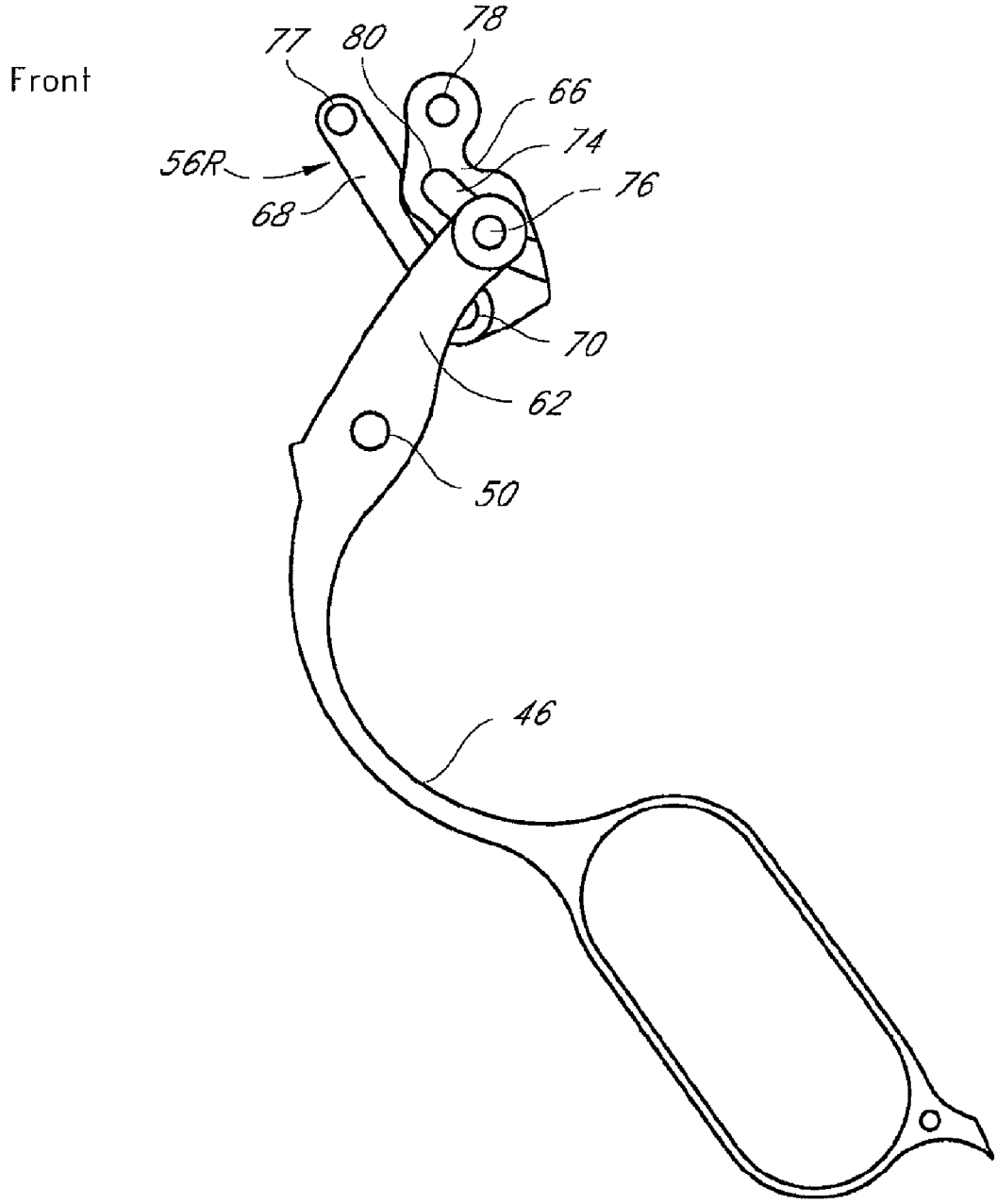
FIG. 6 is a side view of the toggle link and lever assembly removed from the rifle of FIG. 1 and shown in the open position.

FIGS. 4-6 illustrate with greater detail how the lever 46 and the toggle link 56R work together during an opening cycle of the lever 46. Once again, it should be noted that, for clarity, FIGS. 4-6 show only a right hand toggle link 56R and when fully assembled, the action 34 includes a mirroring left hand toggle link 56L. FIG. 4 is an illustration of the toggle link 56R and the lever arm 62 at the first portion of an opening cycle of the lever 46. As the lever 46 starts to rotate down and forward, shown by arrow A, the lever arm 62 of the lever 46 begins to rotate down and rearward, shown by arrow B. This rotation in turn begins the rotation, shown by arrow C, of the rearward toggle link 66 which in turn draws the central toggle pivot 70 down and rearward, shown by arrow D. This downward movement of the central toggle pivot 70 draws the forward toggle pivot 77 back, shown by arrow E, which in turn pulls the breech block 58 back and out of the chamber 48 of the rifle 30 (shown in FIG. 3). As the lever arm 62 begins to rotate, the lever arm pivot pin 76 begins to move closer to the rearward toggle pivot 78. As a result the lever arm pivot pin 76 travels up, shown by arrow F, the slide channel 74 towards the rearward toggle pivot 78.

FIG. 5 illustrates the lever 46 partially through its opening cycle. In this stage, the lever 46 is continuing to rotate down and forward, shown by arrow A, and the lever arm 62 is continuing to rotate down and rearward, shown by arrow B. The rearward link 66 continues to rotate down and rearward, shown by arrow C, which draws the central toggle pivot 70 down and back, shown by arrow D. The rotation of the rearward link 66 pulls the forward toggle pivot 77 directly back, shown by arrow E, and continues to draw the breech block 58 back and out of the chamber 48. In this stage of the opening stroke, the lever arm pin 76 has traveled up the slide channel 74 to the terminal end of the slide channel 80. As the lever 46 continues to rotate the lever arm 62, the lever arm pin 76 begins to travel down and out of the slide channel 74, as shown by arrow G. The reversal of the travel direction of the lever arm pin 76 in the slide channel 74 occurs when the lever arm pin 76 and the rearward toggle pivot 78 are at a minimum distance from each other during their action paths. During the first portion of the lever opening cycle the rearward toggle pivot 78 and the lever arm pivot pin 76 draw closer together while during the latter part of the lever opening cycle the rearward toggle pivot 78 and the lever arm pivot pin 76 move farther apart.

FIG. 6 illustrates the toggle link 56R and the lever 46 in the fully open position. This position includes the toggle link 56R in the fully collapsed position with the forward link 68 nested against the rearward link 66. At this point in the lever cycle the breech block 58, which is connected to the forward link pivot 76, has been drawn back and out of the chamber 48 (shown in FIG. 3) to allow ejection of a used cartridge and reloading of a new cartridge. As the shooter draws the lever 46 up and rearward the cycle is reversed to close the chamber 48 and prepare the rifle 30 for another shot.

During the lever cycle, the corresponding functions of the action 34 are controlled, for a given lever geometry, by the geometry of the slide channel 74 of the rearward link 66. By changing the configuration of the slide channel 74, the force and distance of the stroke of the lever 46 can be manipulated. It is desirable to produce a steady force on the lever 46 during the opening stroke. This is accomplished by altering the geometry of the slide channel so that the multiple operations that are actuated by the opening of the lever 46 do not correspond at their peak intensities. That is, it is desirable to assure that the most difficult phase of cocking the hammer back and overcoming the hammer spring does not occur in the same part of the lever stroke as the difficult phase of lifting out a spent shell and overcoming the resistance offered by the lifter arm 63, for example. This goal of a short and smooth lever cycle is accomplished with the toggle links 56 of FIGS. 7-10 as described in greater detail below.

Figure 7:
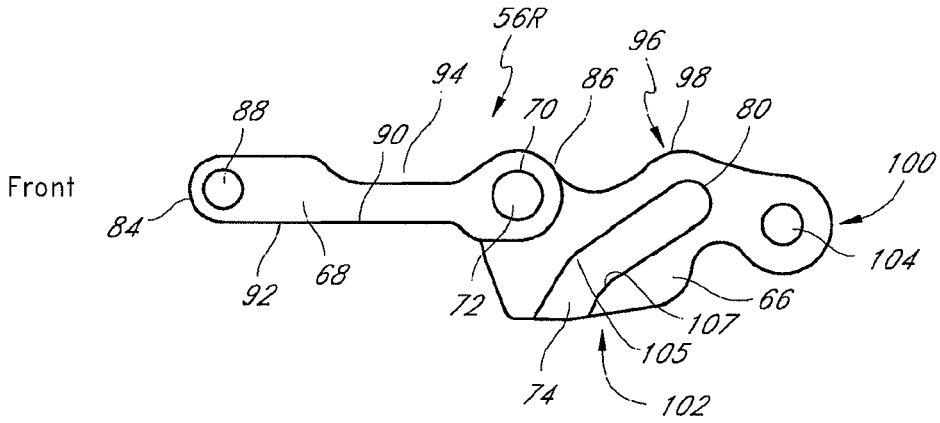
FIG. 7 is a side view of a right hand toggle link of the rifle of FIG. 1 in the extended position.
Figure 8:
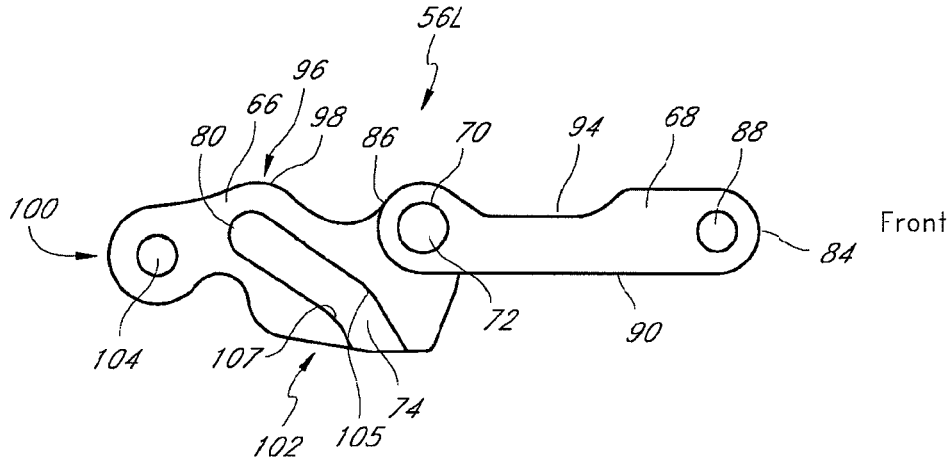
FIG. 8 is a side view of a left hand toggle link of the rifle of FIG. 1 in the extended position.

FIGS. 7-10 illustrate an embodiment of a pair of toggle links 56 that are designed to yield a shorter lever stroke and smoother lever action. FIG. 7 illustrates a right hand toggle link 56R and FIG. 8 illustrates a left hand toggle link 56L The right hand link 56R and the left hand link 56L are substantially similar with some small differences that will be discussed in greater detail below. For convenience similar structures and components of the left hand link 56L and the right hand link 56R will be referred to by the same reference numerals as used in FIGS. 1-6. Also, all relative directions of the toggle links disclosed herein are done so with the toggle links in the extended position with the front and top of the toggle link corresponding to the top and front of the rife.

The toggle links, as discussed above, include a rearward link 66 and a forward link 68 which are connected by a central toggle pivot 70. The central toggle pivot 70 is preferably a clevis pivot with the rearward link 66 including a narrowed eyelet that slips between two eyelets on the forward link 68. The links are connected by a central pivot pin 72.

The forward link 68 is a substantially rectangular shape with a heavily rounded forward end 84 and rearward end 86. The rounded forward 84 and rearward 86 ends preferably parallel the pin of the central pivot 72 and the forward pivot hole 88. The forward link 68 includes a flat lower surface 90 that extends over a longitudinal length of the forward link 68. The right hand link 56R shown in FIG. 7 is configured to define a recess 92 that is advantageously sized and shaped for clearance for other structures in the action 34. In the illustrated arrangement, the upper surface of the forward link 68 defines a generally rectangular clearance recess 94 towards the rear of the forward link 68 that is configured to nest with the upper surface 96 of the rearward link 66 when the toggle links 56 are in the collapsed position as shown in FIGS. 9 and 10.

Figure 9:
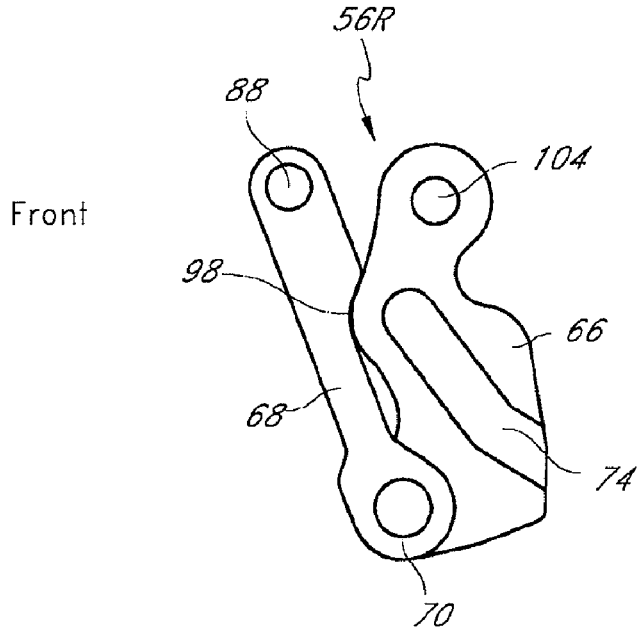
FIG. 9 is a side view of a right hand toggle link of the rifle of FIG. 1 in the collapsed position.
Figure 10:
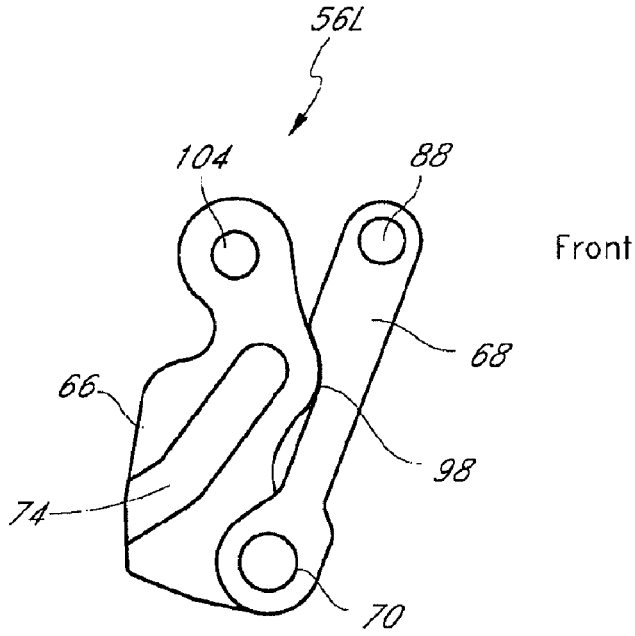
FIG. 10 is a side view of a left hand toggle link of the rifle of FIG. 1 in the collapsed position.

With continued reference to FIGS. 9 and 10, the forward taper of the recess 94 is configured to rest on the rearward portion of the hump 98 of the upper surface 96 of the rearward link 66 when the links 56 are collapsed. This recess 94 assures that the toggle links 56 can sufficiently collapse to fully draw back the breech block 58 when the lever 46 is in the open position.

With reference to FIGS. 7 and 8, the rearward link 66 includes an upper surface 96, a rearward surface 100, and a bottom surface 102. The rearward surface 100 is located at the rearward most portion of the rearward link 66 and is generally curved in shape. The curve of the rearward surface 100 primarily follows the curvature of the rearward pivot pin hole 104 and continues farther upward on the bottom of the rearward surface 100 to allow clearance for a frame cavity cover screw (not shown).

The bottom surface 102 of the rearward link 66 is substantially flat and extends from the rearward surface 100 towards the front of the rearward link 66. The bottom surface 102 further includes a preferably chamfered edge that transitions the flat portion of the bottom surface 102 up and towards the central toggle pivot 70.

The upper surface 96 of the rearward link 66 includes a small flat portion that is located nearest to the central toggle pivot 70. The upper surface 96 also includes a centrally located hump 98 that extends above the small flat portion and is configured to substantially parallel the rounded profile of a terminal end of the slide channel 80. The hump 98 allows sufficient material to be added to the upper surface 96 of the rearward link 66 so as to allow the slide channel 74 to terminate at a relatively high point on the rearward toggle link 66. The hump 98 also allows for a generally constant and substantial wall thickness to be maintained between the upper surface 96 and the terminal end of the slide channel 74. Preferably, the wall thickness between the terminal end of the slide channel 80 and the upper surface 96 is no less than 0.040 inches and desirably no less than 0.060 inches. This wall thickness adds to the structural integrity of the rearward link 66 and reduces the likelihood of failure during firing.

The angle of the slide channel 74 is very critical in controlling the speed of the action 34 of the rifle 30. As the angle of the slide channel 74 increases (relative to the orientation shown in FIGS. 7 and 8) the action 34 of the rifle 30 will correspondingly increase. That is, the steeper the angle of the slide channel 74, the faster the action of the rifle 30. It is therefore desirable to configure the angle of the slide channel 74 to produce desirable action speed.

The hump 98 on the upper surface 96 of the rearward link 66 provides the freedom to tune the angle of the slide channel 74 to an extent that was formerly impossible with an original equipment toggle link (discussed below with reference to FIGS. 19-20). When compared to an original equipment toggle link the hump 98 allows the terminal end of the slide channel 80 to protrude outside of an original profile of an original equipment toggle link and, desirably, above a line between axes of pivot pins 70 and 104. That is, with the addition of the hump 98, the slide channel 74 can have a much more altered shape.

With continued reference to FIGS. 7 and 8 the toggle links 56 further include a complex, non-linear slide channel 74 that is specifically tuned to provide an improved lever cycle. The slide channel 74 is preferably a rectangular groove, in cross-section, with a rounded terminal end 80 and extends partially through the thickness of the rearward link 66. In the illustrated arrangement, the slide channel 74 open through the bottom surface 102 of the rearward link 66 and slopes linearly upward at about a 49 degree angle to an angled transition 105 where the angle of the channel 74 lessens to about a 25 degrees and continues linearly to a rounded terminal end 80. The slide channel 74 also includes a small flat portion 107 on the bottom wall of the angled transition 105 that is configured to allow adequate clearance for the lever arm pin 76 to accommodate for manufacturing variances in various rifles.

The geometry of the slide channel 74 is plotted to preferably provide a short and smooth lever stroke. Although the slide channel 74 is shown as having a curved path made of two non-parallel angled paths, it is also possible to have a curved surface made of one or multiple radii.

Figure 17:
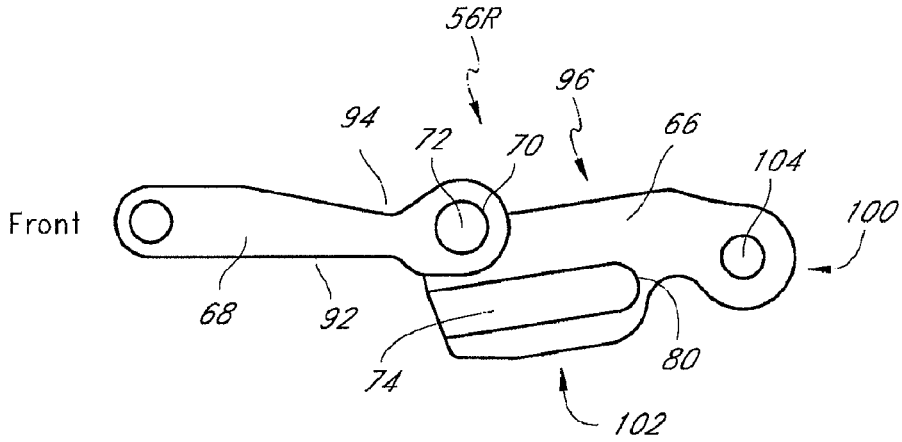
FIG. 17 (PRIOR ART)
FIG. 17 is a side view of a prior art, original equipment, right hand toggle link in the extended position.
Figure 18:
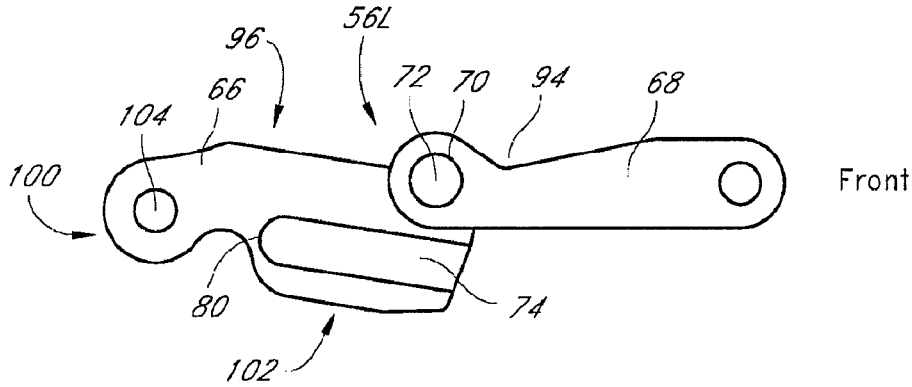
FIG. 18 (PRIOR ART)
FIG. 18 is a side view of a prior art, original equipment, left hand toggle link in the extended position.

The above mentioned angles are measured relative to the path of the slide channel 74 of the original equipment toggle links 56R and 56L of FIGS. 17 and 18, which comprises a specific relation to a line which passes through centerlines of the rearward toggle pivot hole 104 and the central toggle pivot 70. The original equipment toggle links 56R and 56L of FIGS. 17 and 18 comprise a path of the slide channel 74 which is substantially parallel to the bottom surface 102 of the rearward link 66. Thus, if the bottom surface 102 comprises the same relative angle to the centerlines of the rearward toggle pivot hole 104 and the central toggle pivot 70 as the bottom surface 102 of the rearward link 66 of FIGS. 17 and 18, then the angle may alternatively be measured from the bottom surface 102.

The toggle links 56 illustrated in FIGS. 7 and 8 are preferably configured to function with a corresponding modified lever and lifter arm (not shown). The modified lever includes a slightly altered geometry wherein the lever arm pivot pin is shifted back and away from the lever pivot. This alteration mates with the improved geometry of the slide channel 74 by placing the lever arm pivot pin 76 farther up the slide channel 74 when the lever is in the closed position.

The modified lifter arm (not shown) is configured to be lowered faster during the lever closing cycle. This is accomplished by adding a small amount of material to the rearward portion of the lifter arm (not shown) and also by adding a small amount of material to the lever arm 62 forward of the lever pivot 50 where the two components contact one another. The modified components more aggressively lower the carrier block sooner in the lever closing cycle in response to the increased speed of the action 34 that is provided by the slide channel 74 of toggle links 56 in FIGS. 7 and 8. It is also possible to use the toggle links 56 of FIGS. 7 and 8 with the original lever and lifter arm that are supplied with a replica of a Winchester Model 1866 or 1873, however the results may not be equally desirable.

Figure 11:
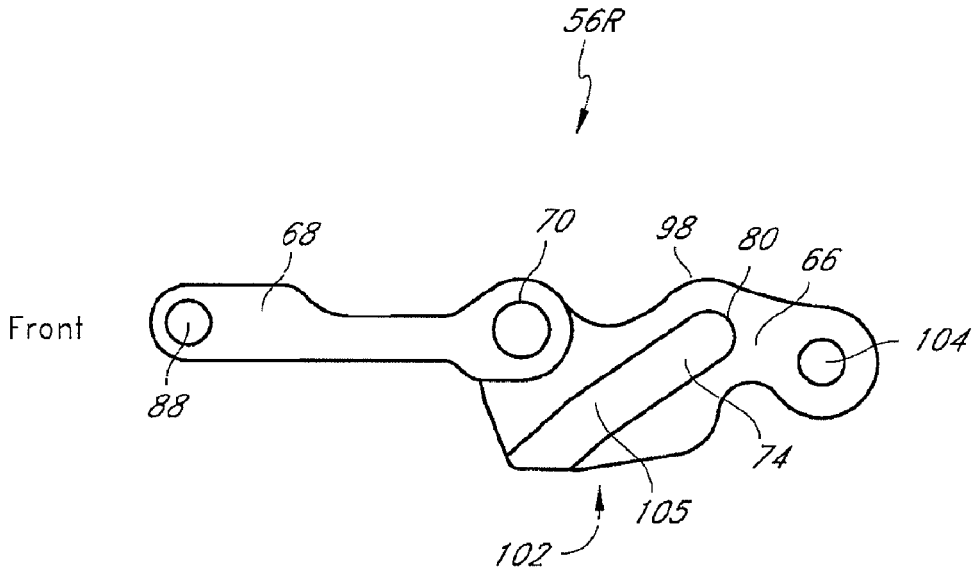
FIG. 11 is a side view of modification of the right hand toggle link of FIG. 1 in the extended position.
Figure 12:
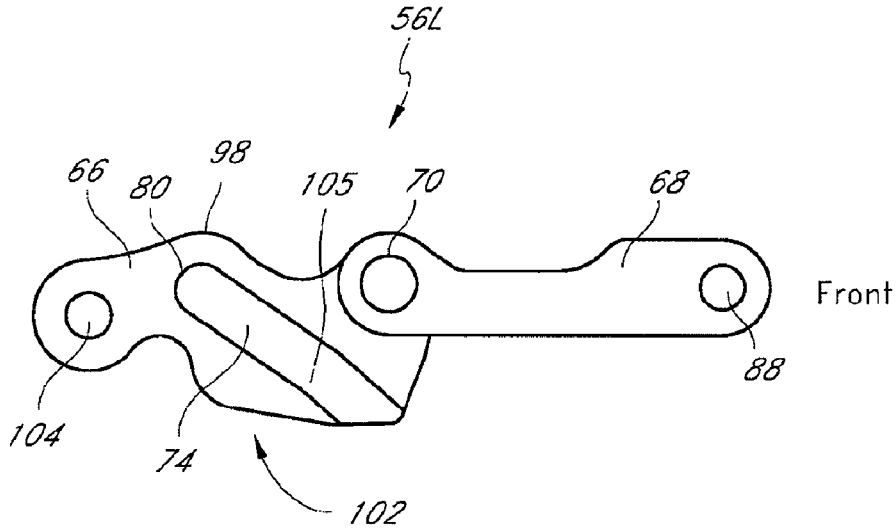
FIG. 12 is a side view of modification of the left hand toggle link of FIG. 1 in the extended position.

FIGS. 11 and 12 illustrate another embodiment of a set of toggle links. The toggle links of FIGS. 11 and 12 are substantially similar to the toggle links of FIGS. 1-10. For convenience, similar components and structures will be referred to by the same reference numerals as in FIGS. 1-10. The toggle links preferably include the same outside shape and components as the toggle links described above. The substantially different element of the toggle link of FIGS. 9 and 10 from that of FIGS. 7 and 8 include the orientation and geometry of the slide channel 74.

The slide channel 74 is configured to include a different path than that of the previous embodiment illustrated in FIGS. 7-10. The illustrated slide channel begins on the front of the bottom surface 102 of the rearward link 66 and follows about a 31 degree path upwards to a transition curve 105 from which the slide channel 74 proceeds at about a 25 degree angle. The starting end of the slide channel 74 illustrated in FIGS. 11 and 12 starts farther forward on the rearward link 66 than the slide channel 74 illustrated in FIGS. 7-10. The different slide channel path is configured to produce results that are similar to the previous embodiment, but with a different overlap of functions (e.g., lifting of the carrier, cocking of the hammer) throughout the lever stroke.

Figure 13:
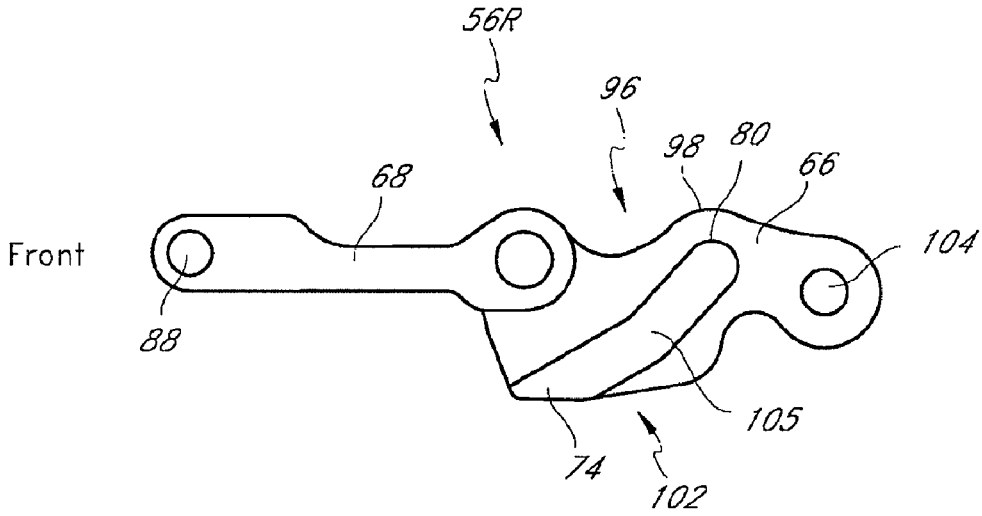
FIG. 13 is a side view of another modification of the right hand toggle link of FIG. 1 in the extended position.
Figure 14:
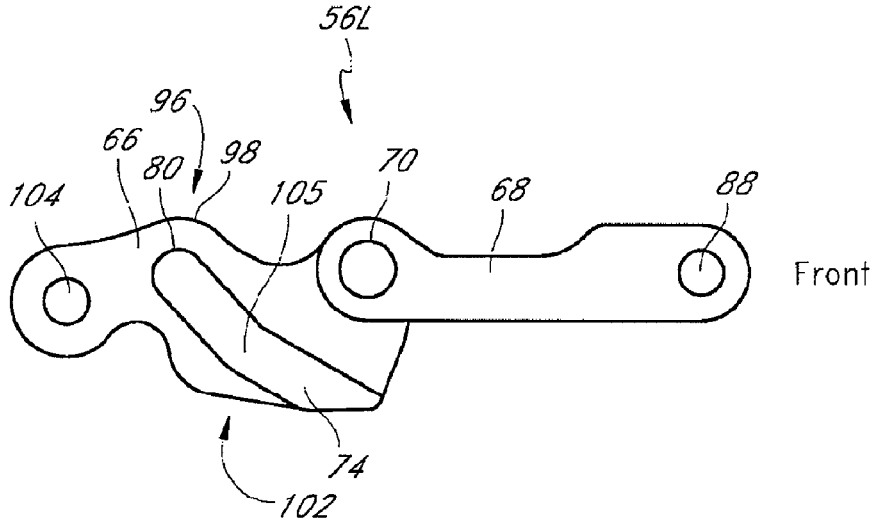
FIG. 14 is a side view of another modification of the left hand toggle link of FIG. 1 in the extended position.

Another toggle link embodiment is illustrated in FIGS. 13 and 14. Once again, similar components will be referred to by the same reference numerals used in previous FIGS. 1-12.

The toggle links 56 again include the same structure with a rearward link 66 and a forward link 68. The links are pivotally connected to the center toggle pivot 70. The rearward link 66 again includes a hump 98 on the upper surface 96 of the rearward link 66 that is configured to allow the slide channel 74 to have higher terminal end 80. Once again, when compared to an original equipment toggle link the hump 98 allows the terminal end of the slide channel 80 to protrude outside of an original profile of an original equipment toggle link and, desirably, above a line between axes of pivot pins 70 and 104.

The major difference in the toggle links 56 of FIGS. 13 and 14 include, once again, the geometry of the slide channel 74. The slide channel 74 begins on the bottom surface 102 of the rearward link 66 and slopes upward at about a 21 degree angle to an angled portion 105 of the slide channel 74 where the slide channel 74 proceeds linearly at about a 38.5 degree angle to a terminal end of the slide channel 80. One notable difference of the slide channel 74 is that it begins at a shallower angle and progresses to a steeper angle at an angled portion 105. This is in opposition of previous embodiments where the slide channel 74 begins with a steeper angle and ends with a shallower angle. This altered geometry of the slide channel 74 once again provides a relatively short lever stroke and a smooth lever cycle.

Figure 15:
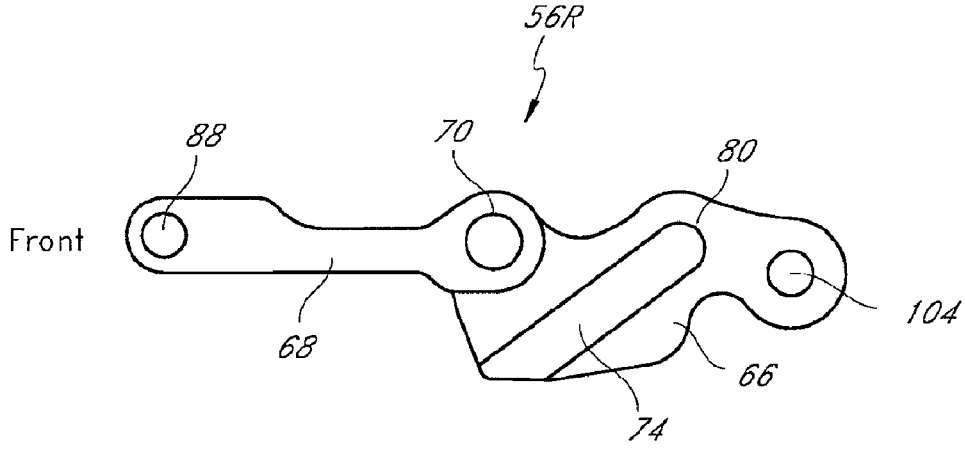
FIG. 15 is a side view of yet another modification of the right hand toggle link of FIG. 1 in the extended position.
Figure 16:
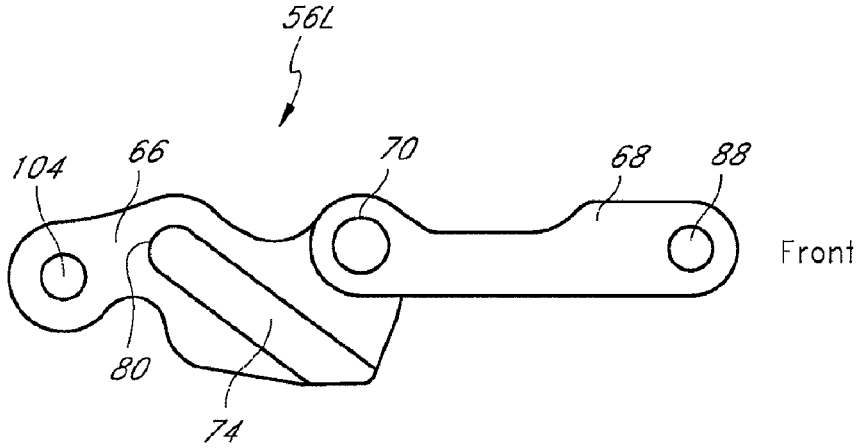
FIG. 16 is a side view of yet another modification of the left hand toggle link of FIG. 1 in the extended position.

Another toggle link embodiment is illustrated in FIGS. 15 and 16. Once again, similar components will be referred to by the same reference numbers used in previous FIGS. 1-14. The toggle links 56 again include the same structure with a rearward link 66 and a forward link 68. The links 66 and 68 are pivotally connected at the center toggle pivot 70. The rearward link 66 again includes a hump 98 on the upper surface 96 of the rearward link 66 that is configured to allow the slide channel 74 to have higher terminal end 80.

The difference from previous embodiments is that the toggle links 56 of FIGS. 15 and 16 include a linear slide channel 74. The slide 74 begins at the front of the bottom surface 102 of the rearward link 66 and slopes upward towards the rearward toggle pivot hole 104 between about a 15 and 40 degree angle and preferably, at a 32 degree angle. This slide channel 74 is linear with no changes in directions as seen in previous embodiments. This slide channel 74 once again provides a short lever stroke and smooth lever cycle.

FIGS. 17-20 depict two different sets of prior art toggle links. The original toggle links 56 that are commonly supplied with a Winchester Model 1966 or Model 1973 rifle or any suitable replica include a linear slide channel 74 that is substantially parallel with the bottom surface 102 of the rearward link 66. The terminal end of the slide channel 80 is below the rearward pivot pin hole 104 when the toggle links 56 are in the extended position.

The shape of the original rearward link 66 includes a rearward surface 100 a bottom surface 102 and a upper surface 96. The rearward surface 100 includes a curved profile that substantially parallels the rearward pivot pin hole 104 and further includes a flat upper portion that is substantially parallel with a line between the rearward pivot pin hole 104 and the central toggle pivot 70. The bottom portion includes a flat surface that is parallel to the slide channel 74. A flat surface on the upper surface 96 and the flat surface of the bottom surface 102 are also substantially parallel.

The forward link 68 is substantially shaped similarly to an elongated rectangle with considerably curved edges. The shape is further modified with a triangular recess 94 defined by the upper surface of the forward link 68 that is configured to allow the upper surface 96 of the rearward link 66 to contact the forward link 68 when the toggle links 56 are in the collapsed position. The forward link 68 of the right hand toggle link 56R of FIG. 17 further defines a flat rectangular recess 92 that is included for clearance from other components of the action 34 of the rifle 30.

The slide channel 74 of the rearward link 66 is formed through a substantial thickness of the rearward link 66 but does not extend though the entire thickness of the rearward link 66. Traveling from the rearward pivot pin hole 104 towards the front of the toggle links 56, the slide channel 74 is sloped slightly downward with the upper terminal end 80 being spaced below the rearward pivot pin hole 104.

The connection of the forward link 68 and the rearward link 66 is a clevis link. The rearward link 66 includes an eyelet that extends upward to interface between two eyelets on the rearward portion of the forward link 68. The eyelets of the forward link 68 are located on either side of the eyelet of the rearward link 66. The eyelet of the rearward link 66 is sufficiently thin as to fit between the eyelets of the forward link 68. The links are connected with a pin 72 that is kept in place by peening.

The toggle links 56 of FIGS. 17 and 18 result in a lever stroke that is longer that the lever stroke provided by the toggle links 56 of FIG. 7-16. This is due, at least in part, to the shape and geometry of the slide channel 74 and the outer shape of the toggle links 56 of FIGS. 17 and 18.

Figure 19:
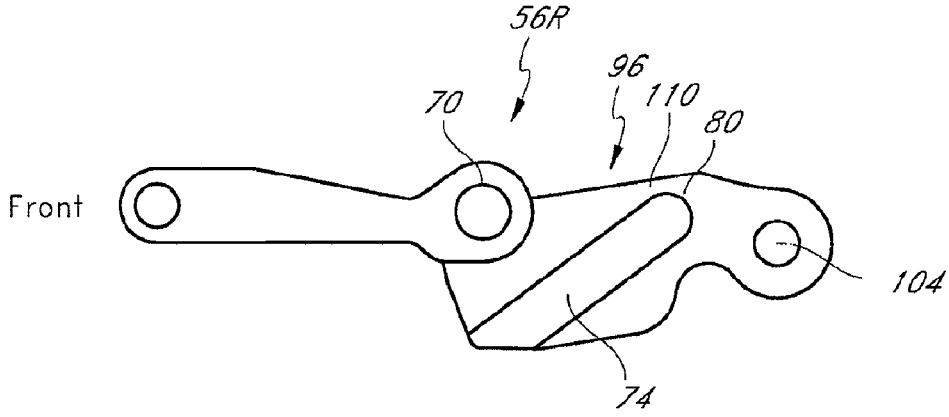
FIG. 19 (PRIOR ART)
FIG. 19 is a side view of a prior art, modified, right hand toggle link in the extended position.
Figure 20:
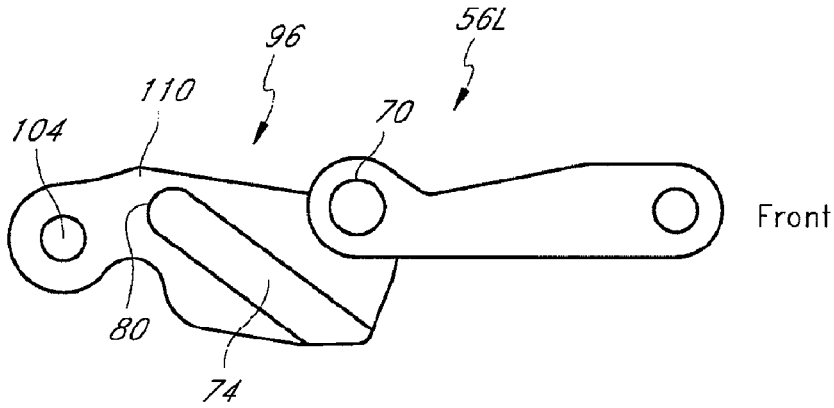
FIG. 20 (PRIOR ART)
FIG. 20 is a side view of a prior art, modified, left hand toggle link in the extended position.

FIGS. 19 and 20 illustrate a modification of a standard toggle link that is currently available. The toggle links of FIGS. 19 and 20 are substantially similar to the toggle links of FIGS. 17 and 18. For convenience the same reference numerals used in FIGS. 1-18 will be used to describe similar structures in FIGS. 19-20.

The modified toggle links of FIGS. 19 and 20 include the same outer shape of the original toggle links 56 of FIGS. 17 and 18. The toggle links 56 of FIGS. 19 and 20 are modified by altering the angle of the slide channel 74 so that the terminal end of the slide channel 80 is located above the rearward pivot hole 104. This modification results in a shorter distance that the lever 46 of the rifle 30 must be displaced in order to cycle the action 34. One problem that has not been previously identified with this modification is that the wall thickness 110 between the terminal end of the slide channel 80 and the upper surface of the upper surface 96 is dangerously small. This reduced wall thickness 110 can be very hazardous to a shooter because the structure of the toggle links 56 is very critical in holding the breech block 58 in the closed position when firing the rifle 30. If the toggle links 56 are sufficiently weak, the breech block 58 could be blown back and out of the chamber 48 when a cartridge is discharged.

Another shortcoming of this modification technique is that the angle of the slide channel 74 can only be increased as much as the original profile of the toggle links 56 will allow. That is, if it is desired to raise the terminal end of the slide channel 80 farther above the rearward pivot pin hole 104, it is not possible, due to the lack of material in the original profile of the rearward link 66.

With returning reference to FIG. 2, another modification that presently exists to shorten the stroke of the lever 46 is to shorten the lever arm 62 of the lever 46. This is commonly done by cutting the lever arm 62 and removing a small portion of the lever arm 62, thus shortening the distance between the lever pivot pin 76 and the lever arm pivot 50. After a portion of the arm 62 has been removed the arm 62 is then reattached, in its shortened condition, by welding.

This modification has a severe shortcoming that is not commonly known, which is, that it effectively lowers the central toggle pivot 70 when the lever 46 is in the closed position. This renders the links 56 to not be fully extended, or not in full battery, when the rifle 30 is fired. When the toggle links 56 are not in a full battery position it may be easily collapsed by the force exerted on the breech block 58 by the exploding gun powder in a cartridge. This could yield the rifle 30 to malfunction and to possibly injure the shooter. The embodiments disclosed herein provide short, smooth lever stroke while overcoming the limitations of the prior are discussed above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present rifle bolt linkage mechanism has been described in the context of a particularly preferred embodiment, the skilled artisan will appreciate, in view of the present disclosure, that certain advantages, features and aspects of the linkage mechanism may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. The modified toggle link for an original or a replica of a Winchester Model 1866-1873 rifle comprising: a forward link; and a rearward link, said forward link and said rearward link pivotally coupled to one another; and a substantially non-linear slide channel defined by said rearward link that is substantially non-parallel to a bottom surface of said rearward link; a modified profile that is defined by the outer surfaces of said toggle link that is substantially different than a profile of an original equipment toggle link; wherein said modified profile of said rearward link extends beyond the outer boundary of the original equipment rearward link to accommodate said slide channel; wherein said modified profile includes a hump on an upper surface of said rearward link; wherein said modified profile includes a recess on an upper surface of said forward link which is configured to receive said hump when said modified toggle link is in a collapsed position; and wherein said modified profile of said forward link is configured to accommodate said modified profile of said rearward link.

2. The modified toggle link of claim 1, wherein a wall thickness between a terminal end of said slide channel and an upper surface of said rearward link is no less than about 0.040 inches.

3. The modified toggle link of claim 1, wherein a terminal end of said slide channel extends outside of said profile of said original equipment toggle link.

4. The modified action of claim 1, further comprising a replacement lever wherein material is added to the replacement lever relative to a profile of an original equipment lever at a location where said replacement lever contacts a lifter arm such that movement of the lifter arm is altered in response to movement of the replacement lever.

5. The modified action of claim 1, further comprising a replacement lifter arm wherein material is added to the replacement lifter arm relative to a profile of an original equipment lifter arm at a location where said replacement lifter arm contacts a lever such that movement of the replacement lifter arm is altered in response to movement of the lever.

6. An action for a lever action rifle, comprising;

a toggle link movable by a lever of said rifle to reciprocate a breech block relative to a chamber end of a barrel of said rifle, said toggle link comprising:

a forward link; and a rearward link, said forward link and said rearward link pivotally coupled to one another about a first pivot axis, said rearward link having a second pivot axis;

a slide channel defined by said rearward link, wherein said slide channel passes through a line extending between said first axis and said second axis, wherein an upper surface of said rearward link includes a protruding hump, a portion of which is positioned directly above a terminal end of said slide channel to maintain a minimum material thickness between said terminal end of said slide channel and said upper surface of said rearward link, wherein said hump defines an uppermost point that is positioned forward of a rearward-most edge of said slide channel;

a recess defined by an upper surface of said forward link, said recess having a shape that accommodates said hump when said toggle link is in a collapsed position.

7. The action of claim 6, wherein each of said hump and said recess are generally rounded in shape.

8. The action of claim 6, wherein said minimum material thickness between said terminal end of said slide channel and said upper surface of said rearward link is no less than 0.040 inches.

9. The action of claim 6, wherein said slide channel is oriented at an angle of between 15 and 40 degrees.

10. The action of claim 6, wherein said upper surface of said rearward link includes a curved portion forward of said hump that is concave facing upwards.

11. A modified action for a lever action of an original or a replica of a Winchester Model 1866-1873 rifle, comprising:

a replacement toggle link movable by a lever of said rifle to reciprocate a breech block relative to a chamber end of a barrel of said rifle, said replacement toggle link comprising:

a forward link having an outer shape profile that is modified relative to the outer shape profile of the original forward link; and a rearward link having an outer shape profile that is modified relative to the outer shape profile of the original rearward link, said forward link and said rearward link pivotally coupled to one another about a first pivot axis, said rearward link having a second pivot axis;

a modified slide channel defined by said rearward link, wherein said slide channel has a steeper angle than the original slide channel and passes through a line extending between said first axis and said second axis and wherein at least a terminal end of the slide channel protrudes outside of the outer shape profile of the original rearward link.

12. The modified action of claim 11, wherein said slide channel is oriented at an angle of between 15 and 40 degrees.

* * * * *